US011326606B2

(12) United States Patent
Knapp et al.

(10) Patent No.: US 11,326,606 B2
(45) Date of Patent: May 10, 2022

(54) ABRASION-RESISTANT THRUST BEARINGS FOR ESP PUMP

(71) Applicant: Baker Hughes, a GE Company, LLC, Houston, TX (US)

(72) Inventors: John Knapp, Claremore, OK (US); Brett Taylor Williams, Claremore, OK (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 141 days.

(21) Appl. No.: 16/565,026

(22) Filed: Sep. 9, 2019

(65) Prior Publication Data

US 2020/0080562 A1 Mar. 12, 2020

Related U.S. Application Data

(60) Provisional application No. 62/728,717, filed on Sep. 7, 2018.

(51) Int. Cl.

| | |
|---|---|
| ***F04D 1/06*** | (2006.01) |
| ***F04D 29/046*** | (2006.01) |
| ***F04D 29/041*** | (2006.01) |
| ***F04D 29/44*** | (2006.01) |
| ***F04D 13/08*** | (2006.01) |

(52) U.S. Cl.

CPC ..... *F04D 1/06* (2013.01); *F04D 13/08* (2013.01); *F04D 29/041* (2013.01); *F04D 29/046* (2013.01); *F04D 29/445* (2013.01)

(58) Field of Classification Search

CPC . F04D 1/06; F04D 13/08; F04D 13/10; F04D 29/041; F04D 29/0413; F04D 29/046

See application file for complete search history.

(56) References Cited

U.S. PATENT DOCUMENTS

| | | | | |
|---|---|---|---|---|
| 4,768,888 | A * | 9/1988 | McNaull | E21B 4/003 175/104 |
| 5,160,240 | A | 11/1992 | Wilson | |
| 5,722,812 | A | 3/1998 | Knox et al. | |
| 5,765,950 | A * | 6/1998 | Eno | F04D 29/0413 384/368 |
| 6,068,444 | A | 5/2000 | Sheth | |
| 9,017,043 | B2 * | 4/2015 | Parmeter | F04D 29/0413 417/365 |

(Continued)

OTHER PUBLICATIONS

International Search Report and Written Opinion issued in connection with corresponding PCT Application No. PCT/US2019/050229 dated Nov. 15, 2019.

*Primary Examiner* — Brian P Wolcott
*Assistant Examiner* — Jackson N Gillenwaters
(74) *Attorney, Agent, or Firm* — Crowe & Dunlevy, P.C.

(57) ABSTRACT

A multistage centrifugal pump has a rotatable shaft, a plurality of pump stages and a thrust module. Each of the plurality of pump stages has an impeller connected to the rotatable shaft and a stationary diffuser. The thrust module has a thrust runner and a unitary thrust pad. The unitary thrust pad has an axial wear face adjacent the thrust runner and a radial wear surface adjacent the rotatable shaft. The axial wear face and radial wear surface are integrated as a unitary component. The unitary thrust pad is secured to a thrust pad support with threaded fasteners that are torqued to a predetermined extent.

16 Claims, 4 Drawing Sheets

(56) References Cited

U.S. PATENT DOCUMENTS

| | | | | |
|---|---|---|---|---|
| 9,534,603 | B2 * | 1/2017 | St. John | F04D 13/10 |
| 10,107,079 | B1 * | 10/2018 | Frey | F04D 29/047 |
| 10,280,929 | B2 | 5/2019 | Gahlot et al. | |
| 2006/0204359 | A1 * | 9/2006 | Semple | F04D 29/0413 415/170.1 |
| 2015/0023815 | A1 | 1/2015 | Tetzlaff et al. | |
| 2015/0354582 | A1 * | 12/2015 | Tanner | F04D 1/00 415/1 |
| 2016/0365767 | A1 | 12/2016 | Nelson et al. | |
| 2017/0002823 | A1 | 1/2017 | Gahlot et al. | |
| 2020/0011332 | A1 * | 1/2020 | Hill | F04D 29/041 |

* cited by examiner

ABRASION-RESISTANT THRUST BEARINGS FOR ESP PUMP

RELATED APPLICATIONS

This application claims the benefit of U.S. Provisional Patent Application Ser. No. 62/728,717 entitled "Abrasion-Resistant Thrust Bearings for ESP Pump," filed Sep. 7, 2018, the disclosure of which is herein incorporated by reference.

FIELD OF THE INVENTION

This invention relates generally to the field of downhole turbomachines, and more particularly to multistage centrifugal pumps that include modular thrust bearings.

BACKGROUND

Submersible pumping systems are used in a wide variety of industrial applications including in the recovery of petroleum fluids from subterranean reservoirs, dewatering operations and for moving fluids within geothermal systems. Typically, a submersible pumping system includes a number of components, including an electric motor coupled to one or more high performance pump assemblies. The pump assemblies often employ axially and centrifugally oriented multi-stage turbomachines. Depending on the particular application, production tubing, coiled tubing, well casing, or other conduit can be used to deliver fluids discharged from the pump assembly.

Most downhole turbomachines include one or more impeller and diffuser combinations, commonly referred to as "stages." The impellers rotate within adjacent stationary diffusers. A shaft keyed to the impellers transfers mechanical energy from the motor. During use, the rotating impeller imparts kinetic energy to the fluid. A portion of the kinetic energy is converted to pressure as the fluid passes through the downstream diffuser.

During operation, each impeller generates thrust in an upward or downward direction. "Upthrust" occurs as fluid moving through the impeller pushes the impeller upward. "Downthrust" occurs when the force imparted by the impeller to the fluid creates a reactive downward force. All multistage centrifugal pumps have a single flow rate equilibrium point where the up-thrust and down-thrust generated by the impellers are balanced. Operating the pump at flow rate outside the equilibrium point causes the up-thrust and down-thrust forces to become unbalanced.

In many cases, small thrust washers can be deployed between each impeller and diffuser to provide a wear-resistant surface through which the impeller can transfer thrust to the diffuser. This approach works well in most applications, but in wellbore environments that contain significant abrasives (such as sand) the particulates may rapidly wear the thrust washers and compromise the durability of the pump.

In these situations, dedicated downthrust-radial support modules are interspersed among the pump stages. One dedicated thrust module for every 8 or 9 pump stages is typical. The thrust module does not pump fluid; it simply carries the downthrust from impellers above it and provides radial support to the pump shaft as well. By so doing, it prevents damage to the pump by diverting the impeller downthrust that would otherwise have been sent to each impeller's matching diffuser, which in sandy conditions would have destroyed the thrust washers and ultimately the pump stages themselves.

Thrust modules are designed to be very tough and durable. The wear surfaces are typically made of a carbide, usually silicon carbide, tungsten carbide or zirconia. These materials are very hard and make excellent wear surfaces, but they have the drawback of being brittle, and to cracking or shattering if they are not well-supported. For this reason the wear surfaces are embedded in more ductile support structures, typically Ni Resist alloys.

Embedding the hardened wear surfaces in ductile support structures presents additional technical problems. The coefficients of thermal expansion of the carbide and the ductile support structure are very different, often by a factor of 3 or 4. That means that as the operating temperature of the pump changes the wear surfaces tend either to come loose or to interfere excessively, either of which can lead to the failure of the thrust module, and then the pump.

A prior art thrust module 200 is depicted in FIG. 1. The thrust module 200 includes a thrust bearing 202 and a shaft support 204. The thrust bearing 202 includes a thrust pad 206 that is connected to a thrust pad support 208 with pins 210 and adhesives (not visible). The thrust bearing 202 includes a thrust runner 212 that is coupled to a rotating component and keyed to a shaft 214. The rotating thrust runner 212 transfers downthrust from downstream stages to the stationary components of the thrust bearing 202. The shaft support 204 maintains the radial position of the shaft 214 within the thrust module 200. The shaft support 204 includes a shaft sleeve 216 that is connected to the shaft 214. The shaft sleeve 216 rotates within a shaft support 204 that is secured to the thrust pad support 208 with adhesives. Thus, the prior art thrust module 200 includes multiple components that are secured together with pins and adhesives.

Although the practice of assembling multi-component thrust modules with adhesives, pinning and staking has been widely adopted, each of these techniques suffers from known problems. Adhesives tend to fail and release their parts, which then move around undesirably. Pins and staking prevent parts from actually falling apart, but they also tend to hold parts loosely. All of these retention methods also make the thrust assembly difficult to repair, as those retention methods are not designed to be disassembled. There is therefore a continued need for an improved thrust module for a multistage pump that more effectively and reliably manages axial thrust. It is to these and other deficiencies in the prior art that the present invention is directed.

SUMMARY OF THE INVENTION

In one aspect, the present invention provides a multistage centrifugal pump that has a rotatable shaft, a plurality of pump stages and a thrust module. Each of the plurality of pump stages has an impeller connected to the rotatable shaft and a stationary diffuser. The thrust module has a thrust runner and a unitary thrust pad. The unitary thrust pad has an axial wear face adjacent the thrust runner and a radial wear surface adjacent the rotatable shaft. The axial wear face and radial wear surface are integrated as a unitary component.

In another aspect, the present invention includes an electric submersible pump configured to move fluids from a subterranean wellbore to the surface. The electric submersible pump has a motor and a pump driven by the motor and configured to push fluids from the wellbore to the surface.

The pump is a multistage centrifugal pump that has a pump housing, a rotatable shaft, and a plurality of pump stages, and at least one thrust module. Each of the plurality of pump stages has an impeller connected to the rotatable shaft and a stationary diffuser. The thrust module has a thrust runner, a thrust pad support and a unitary thrust pad. The unitary thrust pad has an axial wear face adjacent the thrust runner. The axial wear face is secured to the thrust pad support with a plurality of threaded fasteners.

In yet another aspect, the present invention includes a thrust module for use in a multistage centrifugal pump that has a rotatable shaft and a plurality of pump stages. The thrust module has a thrust runner, a thrust pad support, a unitary thrust pad and means for securing the unitary thrust pad to the thrust pad support.

WRITTEN DESCRIPTION

Figure 1:
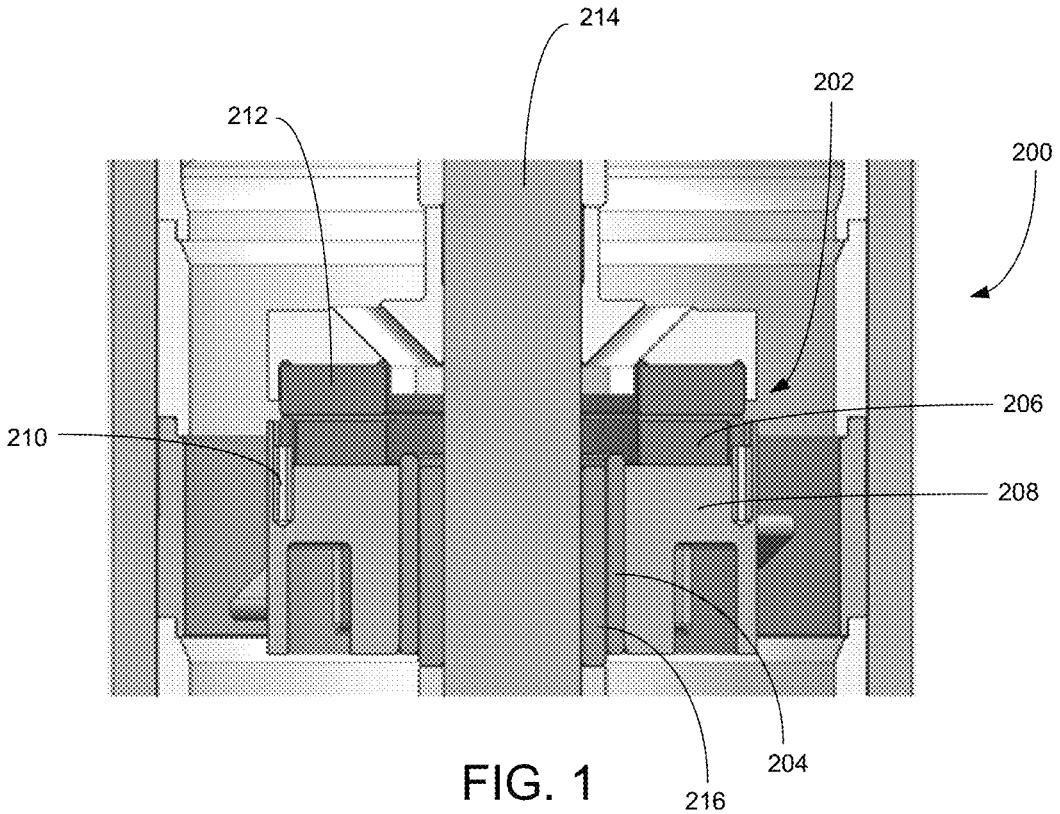
FIG. 1 PRIOR ART
FIG. 1 is a cross-sectional depiction of a PRIOR ART thrust module.
Figure 2:
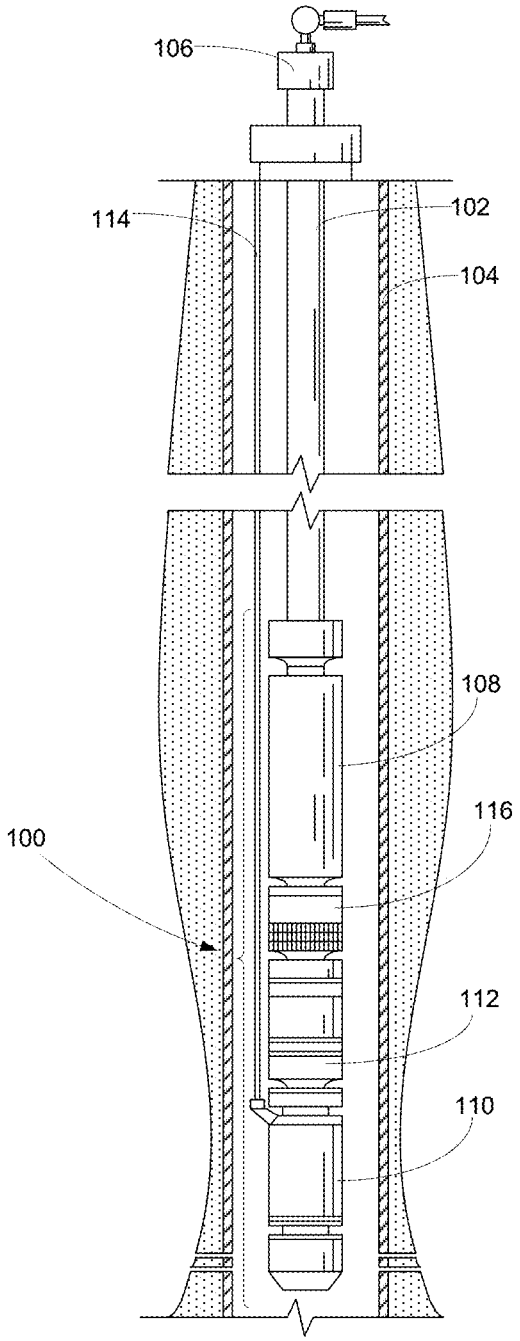
FIG. 2 is a depiction of a submersible pumping system constructed in accordance with an exemplary embodiment.

FIG. 2 depicts a downhole pumping system 100 attached to production tubing 102. The pumping system 100 and production tubing are disposed in a wellbore 104, which is drilled for the production of a fluid such as water or petroleum. As used herein, the term "petroleum" refers broadly to all mineral hydrocarbons, such as crude oil, gas and combinations of oil and gas. The production tubing 102 connects the pumping system 100 to a wellhead 106 located on the surface. Although the pumping system 100 is well suited to recover petroleum products from a subterranean well, it will be understood that the present invention can also be used in other applications, including, but not limited to, dewatering and geothermal applications.

The pumping system 100 includes a combination of a pump 108, a motor 110 and a seal section 112. The seal section 112 shields the motor 110 from wellbore fluids and accommodates the thermal expansion of lubricants within the motor 110. The motor 110 is provided with power from the surface by a power cable 114. The pump 108 is fitted with an intake section 116 to allow well fluids from the wellbore 104 to enter the pump 108, where the well fluid is forced to the surface through the production tubing 102. It will also be appreciated that the pumping system 100 may be deployed in surface-mounted applications, which may include, for example, the transfer of fluids between storage facilities, the removal of liquid on surface drainage jobs, the withdrawal of liquids from subterranean formations and the injection of fluids into subterranean wells.

Although the pumping system 100 is depicted in a conventional "vertical" orientation, it will be appreciated that preferred embodiments of the pumping system 100 can also be installed in horizontal, deviated, or other non-vertical installations. As used in this disclosure, the use of the terms "upper" and "lower" should not be construed as limiting the preferred embodiments to a vertical orientation of the pumping system 100. Instead, as used in this disclosure, the terms "upper" and "lower" are analogous to "downstream" and "upstream," respectively. The terms "downstream" and "upstream" are relative positional references that are based on the movement of fluid through the pump 108.

Figure 3:
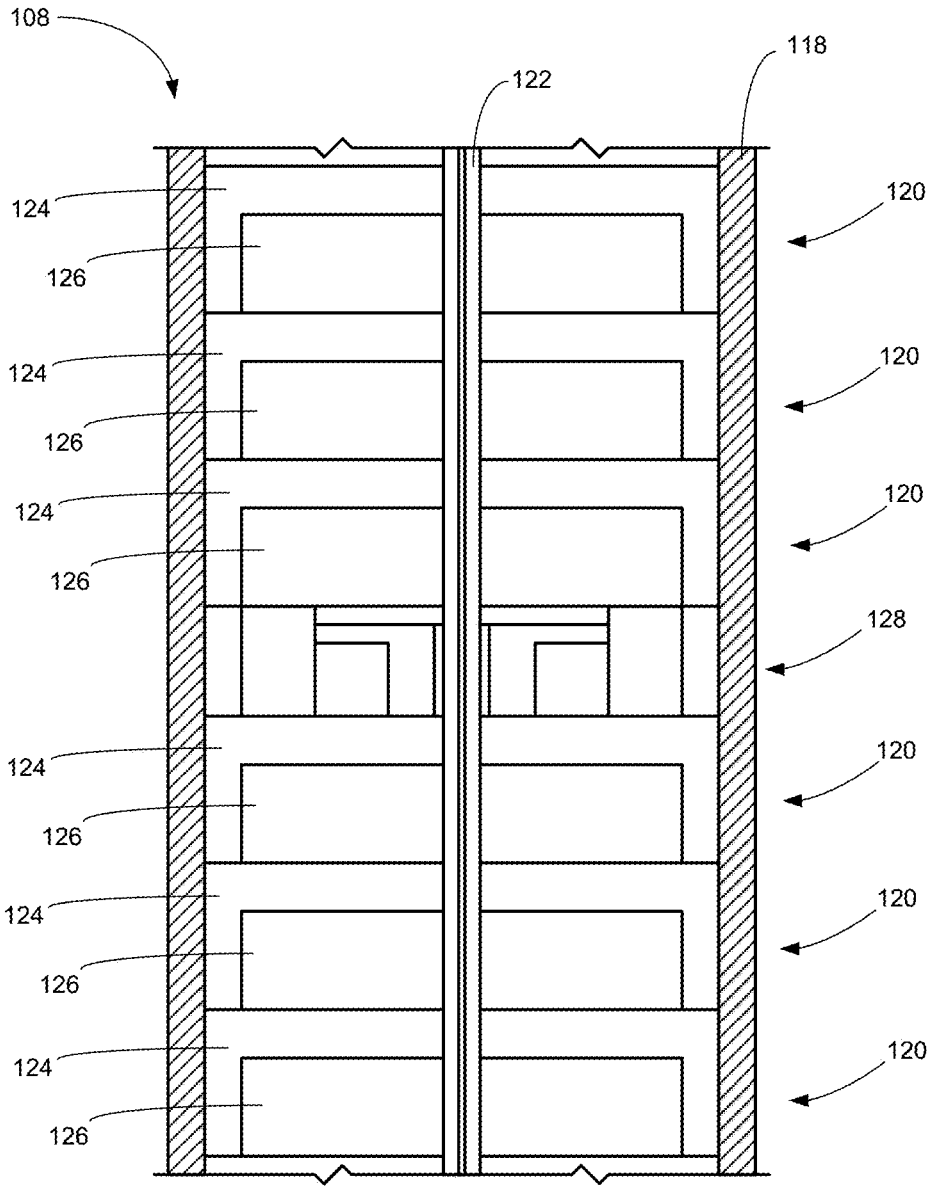
FIG. 3 is a cross-sectional depiction of a portion of the pump from the submersible pumping system of FIG. 2.

Turning to FIG. 3, shown therein is a cross-sectional view of a portion of the pump 108. The pump 108 includes a pump housing 118, one or more turbomachinery stages 120 and a shaft 122. Each of stages 120 includes a diffuser 124 and an impeller 126. Each impeller 126 is connected to the shaft 122 through a keyed connection such that the impellers 126 rotate with the shaft 122. The keyed connection permits a limited amount of axial movement between the impellers 126 and the shaft 122. Each of the diffusers 124 is held in a stationary position within the pump housing 118 by a compressive load or bolted connection. In this way, the shaft 122 and impellers 126 rotate within the stationary diffusers 124. Multiple stages 120 may be grouped together in "modules" for functional and control purposes. A single pump 108 may include a plurality of modules of impellers 126 and diffusers 124.

The pump 108 further includes a thrust module 128. Generally, the thrust module 128 offsets axial thrust loads imparted in upstream and downstream directions through the pump 108, while also providing radial support to the shaft 122. The pump 108 may include a plurality of thrust modules 128 interspersed between the modules of stages 120. In some embodiments, the pump 108 may include a thrust module 128 between each module consisting of 5-10 stages 120. In other embodiments, it may be desirable to install the thrust modules 128 between each stage 120 or at greater intervals within the pump 108.

Figure 4:
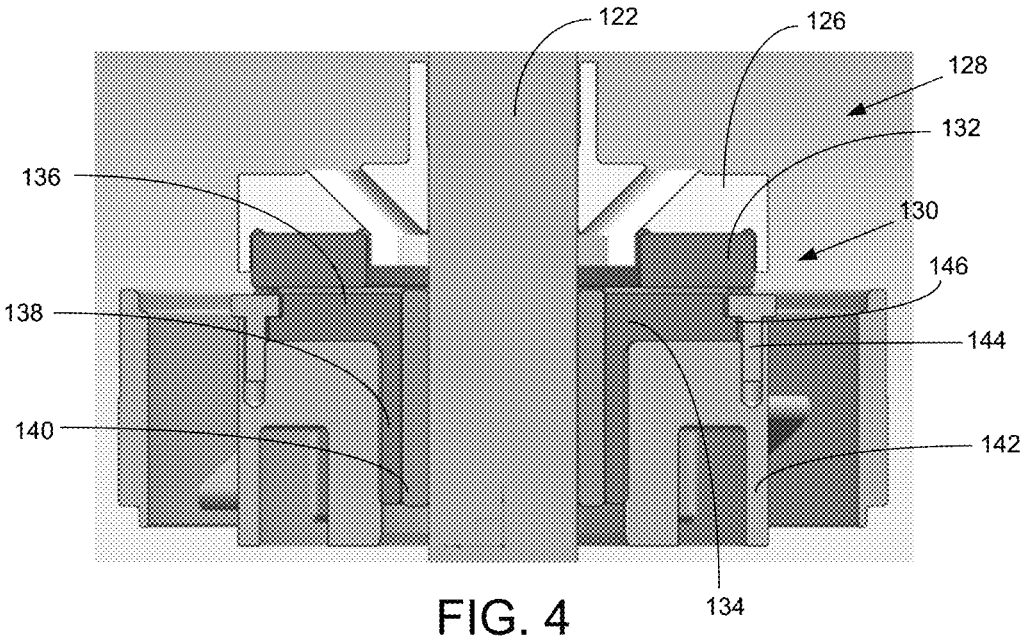
FIG. 4 is a cross-sectional depiction of the thrust module from the pump of FIG. 3.

Turning to FIG. 4, shown therein is a cross-sectional depiction of the thrust module 128. The thrust module 128 includes a thrust bearing 130 that has a thrust runner 132 and a unitary thrust pad 134. The thrust runner 132 is configured for rotation with the shaft 122 and can be connected to a downstream impeller 126. The unitary thrust pad 134 includes an axial wear face 136 opposite the thrust runner 132 and a cylindrical, radial wear surface 138 proximate the shaft 122. The axial wear face 136 is configured for contact with the thrust runner 132. The radial wear surface 138 is configured to directly engage the shaft 122, or an intermediate shaft sleeve 140, as depicted in FIG. 4.

Thus, unlike prior art thrust bearings that include separate axial and radial load surfaces, the unitary thrust pad 134 provides a single component that isolates axial loads produced by the pump stages 120 and provides radial support for the shaft 122. Combining the axial wear face 136 and the radial wear surface 138 into a single component ensures the perpendicularity of these features during manufacture rather than during assembly of individual components. Additionally, integrating the radial wear surface 138 into the unitary thrust pad 134 eliminates the need to separately secure the radial wear surface 138 against rotation or displacement. The thrust runner 132 and unitary thrust pad 134 are both designed for extended contact and are constructed from durable, wear-resistant materials. In some applications, the thrust runner 132 and unitary thrust pad 134 are manufactured from hardened carbide materials.

Figure 5:
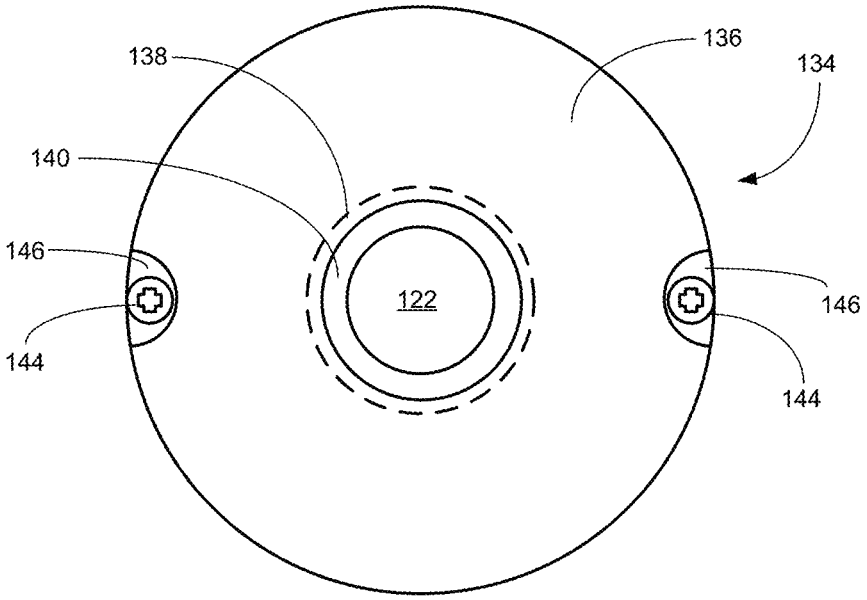
FIG. 5 is a top view of the unitary thrust pad from the thrust module of FIG. 4.

Referring now also to FIG. 5, the unitary thrust pad 134 is connected to a thrust pad support 142, which is located in a stationary manner within the pump housing 118. The thrust pad support 142 can be constructed from metal alloys that are softer and more ductile than the thrust runner 132 and unitary thrust pad 134. The unitary thrust pad 134 is secured to the thrust pad support 142 with threaded fasteners 144. The axial wear face 136 includes bolt recesses 146 that permit the threaded fasteners 144 to be countersunk below the upper surface of the axial wear face 136 when the threaded fasteners 144 are fully engaged with the thrust pad support 142.

In exemplary embodiments, the bolt recesses 146 extend to the outer circumference of the axial wear face 136. The placement of the bolt recesses 146 in this position discourages the accumulation of sand and other particles from the bolt recesses 146 and the axial wear face 136. Unlike the prior art use of pins or stakes, the threaded fasteners 144 not only prevent the unitary thrust pad 134 from rotating during use, but also fasten the unitary thrust pad 134 to the thrust pad support 142 so that adhesives and other bonding mechanisms are not required. When properly torqued, the threaded fasteners 144 will reliably secure the unitary thrust pad 134 to the thrust pad support 142 over a wide temperature range. This presents a significant advantage over the established practice of using pins and adhesives to secure the wear surfaces within a thrust module.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A multistage centrifugal pump comprising:
a rotatable shaft;
a plurality of pump stages, wherein each of the plurality of pump stages comprises:
an impeller connected to the rotatable shaft; and
a stationary diffuser; and
a thrust module, wherein the thrust module comprises:
a thrust runner;
a thrust pad support; and
a unitary thrust pad, wherein the unitary thrust pad comprises:
an axial wear face adjacent the thrust runner;
a plurality of bolt recesses located along an outer circumference of the axial wear face;
a radial wear surface adjacent the rotatable shaft;
wherein the unitary thrust pad is secured to the thrust pad support with a plurality of threaded fasteners, wherein each of the plurality of threaded fasteners is located in a corresponding one of the plurality of bolt recesses; and
wherein the axial wear face and radial wear surface are integrated as a unitary component.

2. The multistage centrifugal pump of claim 1, wherein the thrust module further comprises a shaft sleeve between the shaft and the radial wear surface of the unitary thrust pad.

3. An electric submersible pump configured to move fluids from a subterranean wellbore to the surface, the electric submersible pump comprising:
a motor; and
a pump driven by the motor and configured to push fluids from the wellbore to the surface, wherein the pump is a multistage centrifugal pump that comprises:
a pump housing;
a rotatable shaft;
a plurality of pump stages, wherein each of the plurality of pump stages comprises:
an impeller connected to the rotatable shaft; and
a stationary diffuser; and
a thrust module, wherein the thrust module comprises:
a thrust runner;
a thrust pad support; and
a unitary thrust pad having an axial wear face adjacent the thrust runner, wherein the axial wear face is secured to the thrust pad support with a plurality of threaded fasteners.

4. The electric submersible pump of claim 3, wherein the thrust pad support is fixed in a stationary position within the pump housing.

5. The electric submersible pump of claim 3, wherein the unitary thrust pad further comprises a radial wear surface that surrounds the rotatable shaft.

6. The electric submersible pump of claim 5, wherein the thrust module further comprises a shaft sleeve positioned between the rotatable shaft and the radial wear surface of the unitary thrust pad.

7. The electric submersible pump of claim 6, wherein the axial wear face comprises a plurality of bolt recesses and wherein each of the plurality of threaded fasteners is located in a unique one of the plurality of bolt recesses.

8. The electric submersible pump of claim 7, wherein each of the plurality of bolt recesses is located at an outer circumference of the axial wear face.

9. The electric submersible pump of claim 3, further comprising a seal section disposed between the pump and the motor.

10. The electric submersible pump of claim 3, wherein the pump comprises a plurality of thrust modules.

11. The electric submersible pump of claim 3, wherein the thrust runner is connected to an impeller of one of the plurality of pump stages.

12. A thrust module for use in a multistage centrifugal pump that has a rotatable shaft, a pump housing, and a plurality of pump stages, wherein the thrust module comprises:
a thrust runner;
a thrust pad support;
a unitary thrust pad, wherein the unitary thrust pad comprises:
an axial wear face adjacent the thrust runner;
a radial wear surface that directly engages the rotatable shaft; and
means for securing the unitary thrust pad to the thrust pad support.

13. The thrust module of claim 12, wherein the axial wear face and radial wear surface are integrated as a unitary component.

14. The thrust module of claim 13, wherein the thrust module further comprises a shaft sleeve between the shaft and the radial wear surface of the unitary thrust pad, wherein the shaft sleeve directly engages the rotatable shaft.

15. The thrust module of claim 13, wherein the thrust pad support is fixed in location within the pump housing.

16. The thrust module of claim 12, wherein each of the plurality of pump stages includes an impeller and wherein the thrust runner is connected to an impeller in one of the plurality of pump stages.

* * * * *